US007161540B1

(12) United States Patent
Liu

(10) Patent No.: US 7,161,540 B1
(45) Date of Patent: Jan. 9, 2007

(54) DUAL-BAND PATCH ANTENNA

(75) Inventor: I-Ru Liu, Taipei (TW)

(73) Assignee: Accton Technology Corporation, Hsinchu (TW)

( * ) Notice: Subject to any disclaimer, the term of this patent is extended or adjusted under 35 U.S.C. 154(b) by 0 days.

(21) Appl. No.: 11/209,831

(22) Filed: Aug. 24, 2005

(51) Int. Cl.
*H01Q 1/38* (2006.01)

(52) U.S. Cl. ..... 343/700 MS; 343/846

(58) Field of Classification Search ..... 343/700 MS, 343/702, 846, 848
See application file for complete search history.

(56) References Cited

U.S. PATENT DOCUMENTS 6,091,365 A * 7/2000 Derneryd et al. .... 343/700 MS
6,133,882 A * 10/2000 LaFleur et al. ..... 343/700 MS
7,071,889 B1 * 7/2006 McKinzie et al. ..... 343/756

* cited by examiner

*Primary Examiner*—Hoanganh Le
(74) *Attorney, Agent, or Firm*—Rosenberg, Klein & Lee

(57) ABSTRACT

A dual-band patch antenna is disclosed. The dual-band patch antenna includes a polygon patch constructed from two rectangular radiators (radiating metal patches) combined as the shape similar to Siamese Twins, each of the rectangular radiators having a shorting strip for size reducing. The dual-band patch antenna employs one single common probe feed connected to the overlap portion of two rectangular radiators. When the dual-band patch antenna is operated at about 2.45 GHz and about 5.4 GHz, good radiation pattern and antenna gain are obtained for being applicable to IEEE802.11b/g/a/j or Bluetooth specifications.

15 Claims, 13 Drawing Sheets

DUAL-BAND PATCH ANTENNA

FIELD OF THE INVENTION

The present invention relates to a patch antenna, and more particularly, to the dual-band patch antenna constructed by two jointed substantially rectangular radiators.

BACKGROUND OF THE INVENTION

With the advancement of communication technologies, the applications using communication technologies have also increased significantly, thus making the related products more diversified. Especially, consumers have more demands on advanced functions from communication applications, so that many communication applications with different designs and functions have been continuously appearing in the market, wherein the computer network products with wireless communication functions are the main streams recently. Moreover, with integrated circuit (IC) technologies getting matured, the size of product has been gradually developed toward smallness, thinness, shortness and lightness.

An antenna in the communication products is an element mainly used for radiating or receiving signals, and the antennas used in the current wireless products have to own the features of small size, excellent performance and low cost, so as to be broadly accepted and confirmed by the market. According to different operation requirements, the functions equipped in the communication products are not all the same, and thus there are many varieties of antenna designs used for radiating or receiving signals, wherein a patch antenna is quite commonly used. In order to obtain an antenna with high gain and broadband operation, the distance between the base board and the radiating metal plate can be increased for promoting the radiation efficiency and the operation bandwidth of the antenna. Generally, the features of antenna can be known by the parameters of operation frequency, radiation pattern, return loss, and antenna gain, etc. Hence, the design of patch antenna has to simultaneously consider the factors of appropriate distance between the base board and the radiating metal plate, and good antenna features.

On the other hand, the conventional dual-band antennas merely can cover a relatively small frequency range, and thus can be used in respective specific areas. For example, the frequency bands used in Japan, Europe and USA are all different, and thus different dual-band antennas have to be used in various areas.

However, it is very difficult for the conventional patch antenna, especially for the conventional dual-band patch antenna, to simultaneously have the feature of wide frequency range with the advantages of low cost, small size, high antenna gain, broad operation bandwidth and good radiation pattern, so that the applications of the conventional patch antenna are greatly limited.

Hence, there is an urgent need to develop a dual-band patch antenna for satisfactorily meeting the antenna requirements of wide frequency range, small size, high gain, wide broadband, simple design, low cost and small second harmonic, etc., thereby overcoming the disadvantages of the conventional patch antenna.

SUMMARY OF THE INVENTION

In view of the invention background described above, since the conventional patch antenna cannot effectively satisfy the aforementioned antenna requirements; and can not be used in the areas of different frequency bands, the applications thereof are thus greatly limited.

In an aspect of the present invention, a dual-band patch antenna is provided for having the feature of wide frequency range so as to be applicable to various areas with different frequency bands.

In the other aspect of the present invention, a dual-band patch antenna is provided for meeting the requirements of smallness, thinness, shortness and lightness.

In accordance with the aforementioned aspects of the present invention, the present invention provides a dual-band patch antenna, wherein the antenna comprises a first rectangular radiator and a second rectangular radiator. The first rectangular radiator has a first corner portion and a second corner portion, wherein the second corner portion is diagonally opposite to the first corner portion. The second rectangular radiator has a third corner portion, wherein the second corner portion is orthogonally overlapped with the third corner portion coplanarly so as to form an overlap portion. According to the preferred embodiments of the present invention, both longer sides of the first rectangular radiator can be respectively parallel to the shorter sides or the longer sides of the second rectangular radiator. Moreover, a feeding line is connected to a feed point located on the overlap portion; a first shorting strip is connected to a first short point located on the first corner portion of the first rectangular radiator; and a second shorting strip is connected to a second short point located on one longer side of the second rectangular radiator with a predetermined distance spaced from the shorter side thereof adjacent to the third corner portion, wherein the one longer side is located away from the overlap portion.

Alternatively, the antenna also can be constructed from a first cut-cornered rectangular radiator having a first corner portion and a first connecting side; and a second cut-cornered rectangular radiator having a second connecting side, wherein the first connecting side is the slant line of the cut corner diagonally opposite to the first corner portion, and the second connecting side is the slant line of the cut corner of the second cut-cornered rectangular radiator, and the first connecting side is aligned and connected with the second connecting side coplanarly. The feeding line is connected to the feed point located on the joint of the first connecting side and the second connecting side, and the first shorting strip is connected to the first short point located on the first corner portion of the first cut-cornered rectangular radiator, and the second shorting strip connected to the second short point located on one longer side of the second cut-cornered rectangular radiator with a predetermined distance spaced from the shorter side thereof adjacent to the second connecting side, wherein the one longer side is located away from the joint of the first connecting side and the second connecting side.

Hence, with the use of the present invention, the dual-band patch antenna can cover a wide frequency range, and meet the requirements of smallness, thinness, shortness and lightness.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

The present invention is featured in providing a metal-work antenna including a polygon patch constructed from two rectangular radiators (radiating metal patches) combined as the shape similar to Siamese Twins, each of the rectangular radiators having a shorting strip for size reducing, wherein the metal-work antenna contains one single common probe feed connected to the overlap portion of two rectangular radiators.

Figure 1A:
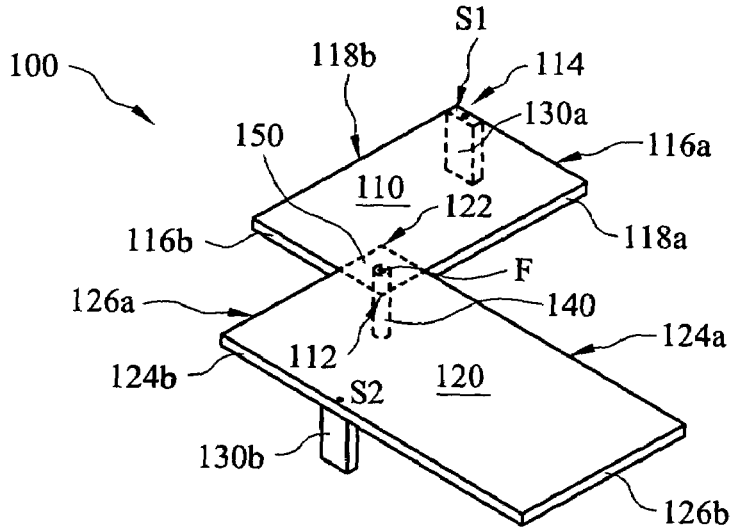
FIG. 1A is a schematic diagram showing the 3-D view of a dual-band patch antenna, according to a first preferred embodiment of the present invention.
Figure 1B:
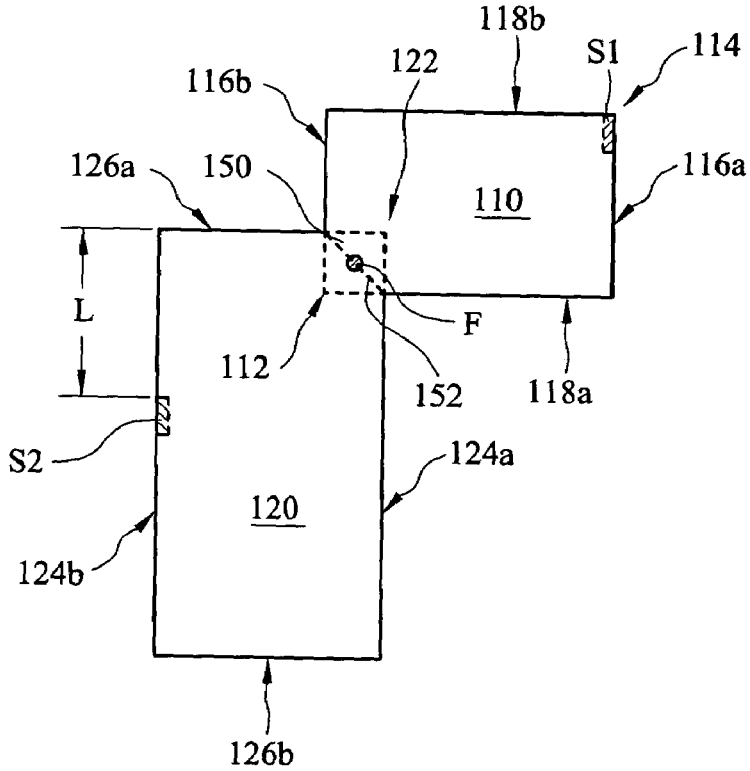
FIG. 1B is a schematic diagram showing the top view of the dual-band patch antenna, according to the first preferred embodiment of the present invention.
Figure 1C:
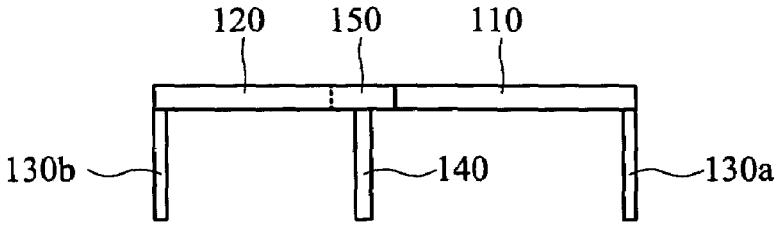
FIG. 1C is a schematic diagram showing the front view of the dual-band patch antenna, according to the first preferred embodiment of the present invention.
Figure 1D:
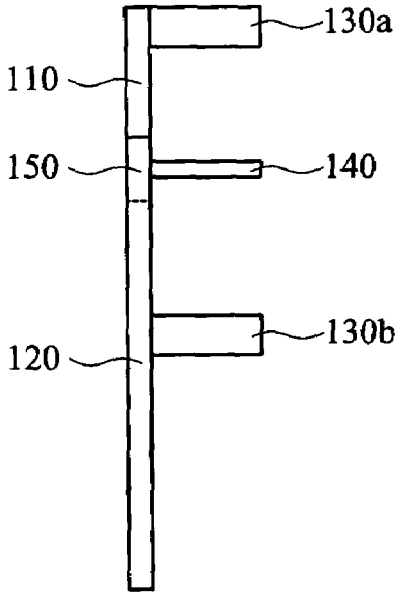
FIG. 1D is a schematic diagram showing the side view of the dual-band patch antenna, according to the first preferred embodiment of the present invention.

Referring to FIG. 1A to FIG. 1D, FIG. 1A to FIG. 1D are schematic diagrams respectively showing the 3-D view, top view, front view and side view of a dual-band patch antenna 100, according to a first preferred embodiment of the present invention. The dual-band patch antenna 100 mainly has a metal radiating element composed of a first rectangular radiator 110 and a second rectangular radiator 120. Such as shown in FIG. 1B, the first rectangular radiator 110 has a first corner portion 114 and a second corner portion 112, wherein the first corner portion 114 is diagonally opposite to the second corner portion 112. The second rectangular radiator 120 has a third corner portion 122, wherein the second corner portion 112 is orthogonally overlapped with the third corner portion 122 coplanarly, thus forming an overlap portion 150, and the shape of the overlap portion 150 can be a rectangle or square.

Alternatively, the dual-band patch antenna 100 also can be constructed from a first cut-cornered rectangular radiator and a second cut-cornered rectangular radiator. The so-called first cut-cornered rectangular radiator is the first rectangular radiator 110 of which part of the second corner portion 112 is slashed off at the connecting side 152, i.e. a portion of the rectangular radiator 110 bordering on the connecting side 152. Similarly, the so-called second cut-cornered rectangular radiator is a portion of the second rectangular radiator 120 bordering on the connecting side 152. The first cut-cornered rectangular radiator has a first corner portion 114 and a first connecting side (shown as the connecting side 152), and the second cut-cornered rectangular radiator has a second connecting side (shown as the connecting side 152), wherein the first connecting side is the slant line of the cut corner (at the second corner portion 112) diagonally opposite to the first corner portion 114, and the second connecting side is the slant line of the cut corner (at the third corner portion 122) of the second cut-cornered rectangular radiator, and the first connecting side is aligned and connected with the second connecting side coplanarly. Therefore, the metal radiating element of the first preferred embodiment also can be formed by directly jointing two cut-cornered rectangular radiators.

Such as shown in FIG. 1A and FIG. 1B, longer sides 118*a* and 118*b* of the first rectangular radiator 110 are respectively parallel to shorter sides 126*a* and 126*b* of the second rectangular radiator 120. A feeding line 140 is connected to a feed point F located on the overlap portion 150 or the joint (the connecting side 152) of those two cut-cornered rectangular radiators, and a first shorting strip 130*a* is connected to a first short point S1 located on the first corner portion 114 of the first rectangular radiator 110, and a second shorting strip 130*b* is connected to a second short point S2 located on a longer side 124*b* of the second rectangular radiator 120 with a predetermined distance L spaced from the shorter side 126*a*, wherein the longer side 124*b* is located away from (not adjacent to) the overlap portion 150 or the connecting side 152. The straight distance between the feed point F and the first short point S1 can be about equal to the straight distance between the feed point F and the second short point S2, i.e. the feed point F and the short points S1 and S2 can form an isosceles triangle, thereby increasing the bandwidths of the dual-band patch antenna so as to be applicable to IEEE802.11b/g/a/j or Bluetooth specifications.

The feeding line 140 can be such as a probe feed, a mircostrip transmission line, a coaxial feeding line, or any other electromagnetic signal transmission line. The metal radiating element of the dual-band patch antenna of the present invention can be made of such as brass, and can be installed on a base board (not shown) by using the first shorting strip 130*a* and the second shorting strip 130*b* as supporting elements, wherein a ground plane made of electrically conductive material is formed on the base board. The first short strip 130*a* and the second short strip 130*b* are connected to the ground plane located on the base board, and the space between the base board and the combination of the first rectangular radiator 110 and the second rectangular radiator 120 is filled with air or low dielectric-constant foam for promoting the radiation efficiency and the operation bandwidth of the antenna.

Further, the size of the dual-band patch antenna according to the first preferred embodiment is quite small, and can meet the requirements of smallness, thinness, shortness and lightness. For example, the first rectangular radiator 110 is smaller than the second rectangular radiator 120. With respect to the first rectangular radiator 110, the length of the longer side 118*b* is about between 8 mm and 15 mm; the length of the shorter side 116*a* is about between 6.5 mm and 10.5 mm. With respect to the second rectangular radiator 120, the length of the longer side 124*b* is about between 25 mm and 35 mm; the length of the shorter side 126*b* is about between 9 mm and 17 mm. The overlap portion 150 can be as large as an area accommodating the feeding line 140, wherein the radius of the feeding line 140 is about between 0.15 mm and 1.5 mm. The predetermined distance L between the second short point S2 and the shorter side 126*a* is about equal to the length of the shorter side 126*b*. The height of the first shorting strip 130*a* and the second shorting strip 130*b* is about between 5 mm and 7 mm.

Figure 2A:
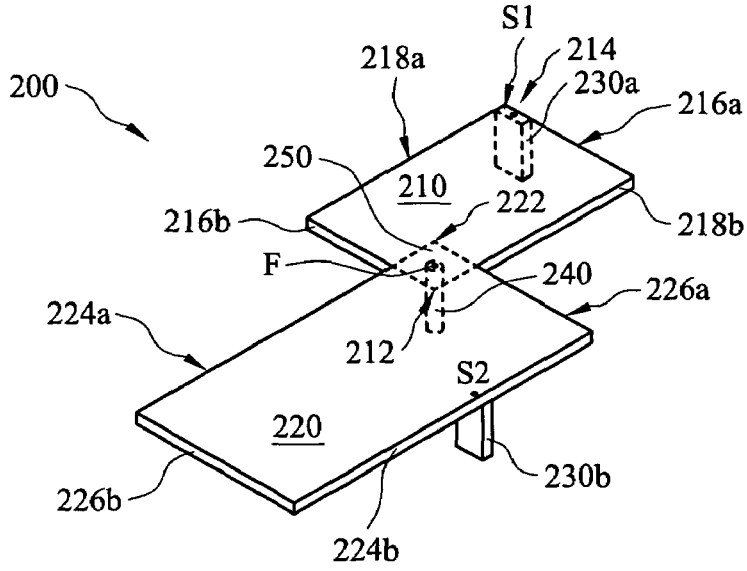
FIG. 2A is a schematic diagram showing the 3-D view of a dual-band patch antenna, according to a second preferred embodiment of the present invention.
Figure 2B:
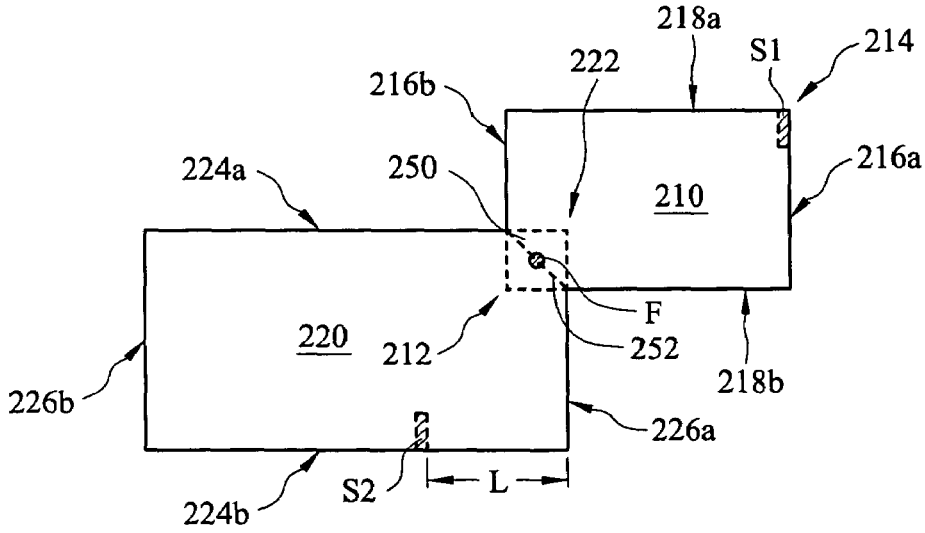
FIG. 2B is a schematic diagram showing the top view of the dual-band patch antenna, according to the second preferred embodiment of the present invention.
Figure 2C:
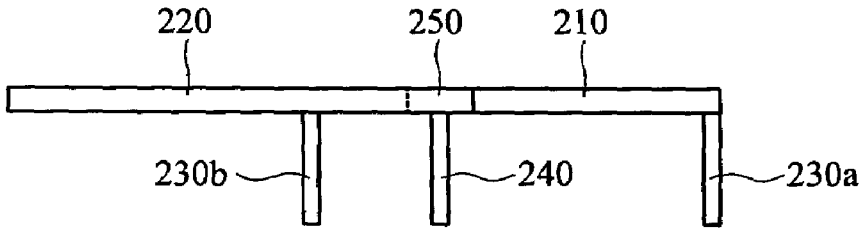
FIG. 2C is a schematic diagram showing the front view of the dual-band patch antenna, according to the second preferred embodiment of the present invention.
Figure 2D:
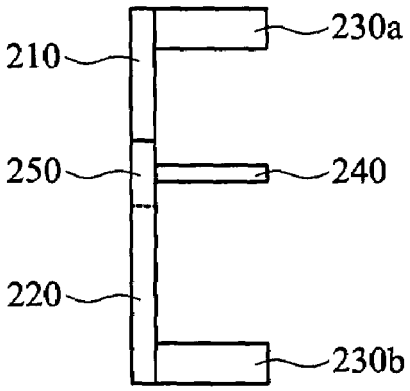
FIG. 2D is a schematic diagram showing the side view of the dual-band patch antenna, according to the second preferred embodiment of the present invention.

Referring to FIG. 2A to FIG. 2D, FIG. 2A to FIG. 2D are schematic diagrams respectively showing the 3-D view, top view, front view and side view of a dual-band patch antenna 200, according to a second preferred embodiment of the present invention. The dual-band patch antenna 200 mainly has a metal radiating element composed of a first rectangular radiator 210 and a second rectangular radiator 220. Such as shown in FIG. 1B, the first rectangular radiator 210 has a first corner portion 214 and a second corner portion 212, wherein the first corner portion 214 is diagonally opposite to the second corner portion 212. The second rectangular radiator 220 has a third corner portion 222, wherein the second corner portion 212 is orthogonally overlapped with the third corner portion 222 coplanarly, thus forming an overlap portion 250, and the shape of the overlap portion 250 can be a rectangle or square. Just as mentioned above in the first preferred embodiment, the dual-band patch antenna 200 also can be constructed from a first cut-cornered rectangular radiator and a second cut-cornered rectangular radiator alternatively. The major difference between the first and second preferred embodiments is that: in the second preferred embodiment, longer sides 218*a* and 218*b* of the first rectangular radiator 210 are respectively parallel to longer sides 224*a* and 224*b* of the second rectangular radiator 220, such as shown in FIG. 2A and FIG. 2B. A feeding line 240 is connected to a feed point F located on the overlap portion 250 or the joint (the connecting side 252) of those two cut-cornered rectangular radiators, and a first shorting strip 230*a* is connected to a first short point S1 located on the first corner portion 214, and a second shorting strip 230*b* is connected to a second short point S2 located on a longer side 224*b* of the second rectangular radiator 220 with a predetermined distance L spaced from the shorter side 226*a*. The straight distance between the feed point F and the first short point S1 can be about equal to the straight distance between the feed point F and the second short point S2, i.e. the feed point F and the short points S1 and S2 can form an isosceles triangle.

Further, the size of the dual-band patch antenna according to the second preferred embodiment is also quite small, and can meet the requirements of smallness, thinness, shortness and lightness. For example, the first rectangular radiator 210 is smaller than the second rectangular radiator 220. With respect to the first rectangular radiator 210, the length of the longer side 218*b* is about between 8 mm and 15 mm; the length of the shorter side 216*a* is about between 7 mm and 11 mm. With respect to the second rectangular radiator 220, the length of the longer side 224*b* is about between 25 mm and 35 mm; the length of the shorter side 226*b* is about between 9 mm and 17 mm. The overlap portion 250 can be as large as an area accommodating the feeding line 240, wherein the radius of the feeding line 240 is about between 0.15 mm and 1.5 mm. The predetermined distance L between the second short point S2 and the shorter side 226*a* is about equal to the length of the shorter side 226*b*, preferably 13 mm. The height of the first shorting strip 230*a* and the second shorting strip 230*b* is about between 5 mm and 7 mm.

It is worthy to be noted that the locations, sizes and materials of each of the components, and the locations of short and feed points mentioned above in the first and second preferred embodiments are merely stated for explanation, so that the present invention is not limited thereto.

From the simulation results, the dual-band patch antenna of the present invention is proved to have excellent antenna features, and can fully cover the bandwidths required by IEEE802.11b/g/a/j or Bluetooth specifications at about 2.45 GHz and 5.4 GHz.

Figure 3A:
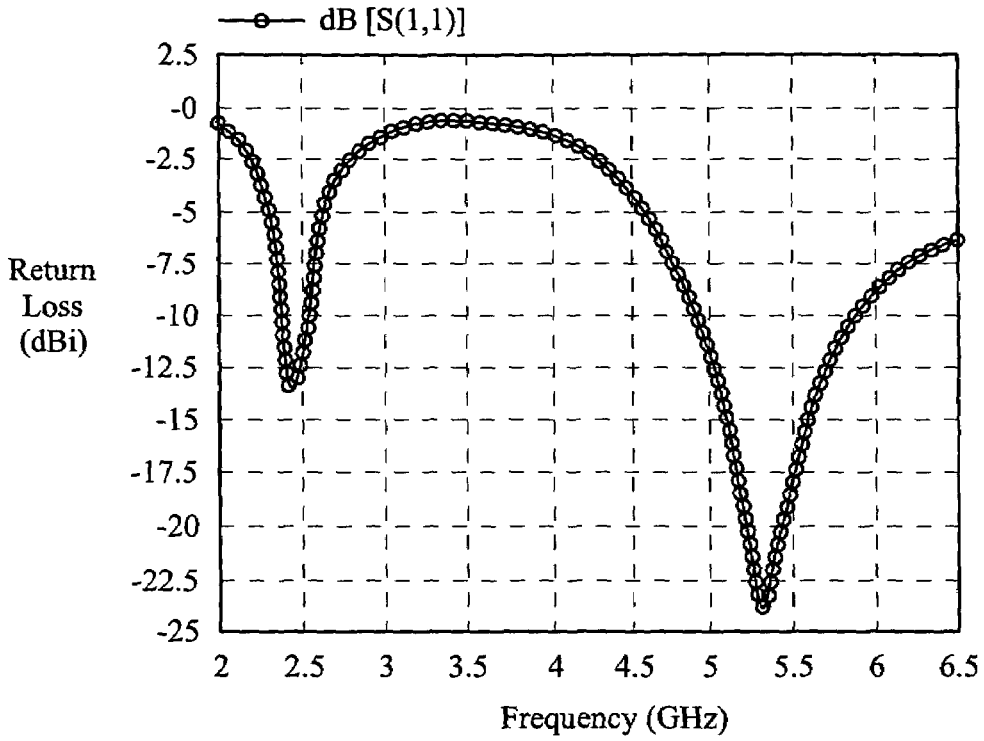
FIG. 3A is a diagram showing a simulation curve of return loss vs. frequency, according to the dual-band patch antenna of the first preferred embodiment of the present invention.
Figure 3B:
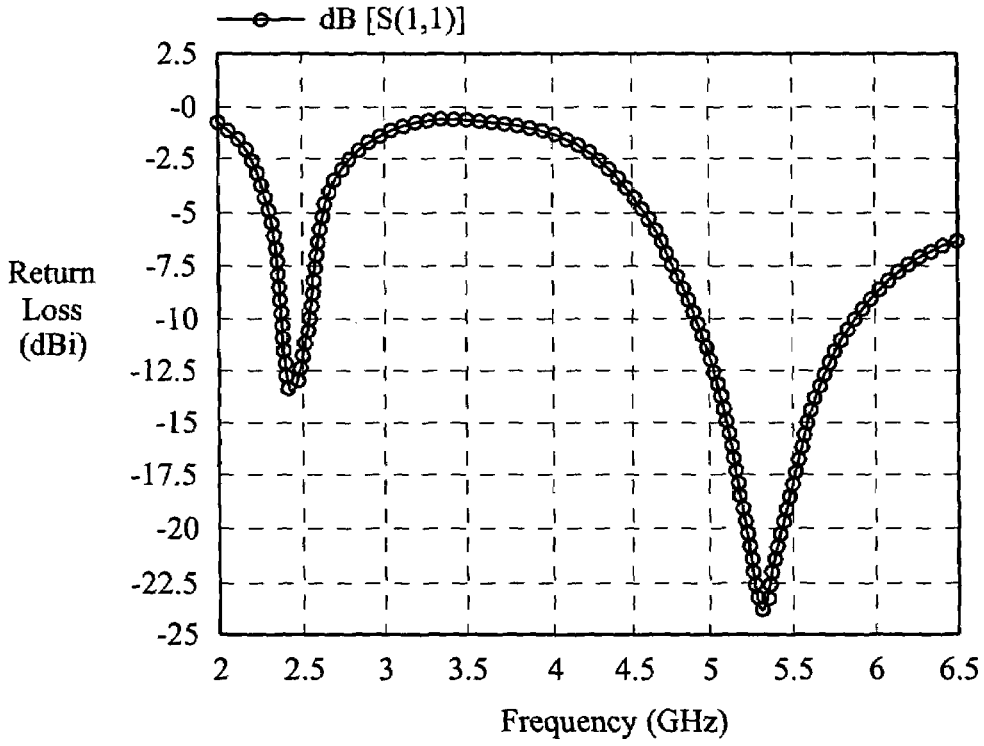
FIG. 3B is a diagram showing a simulation curve of return loss vs. frequency, according to the dual-band patch antenna of the second preferred embodiment of the present invention.

Referring FIG. 3A and FIG. 3B, FIG. 3A and FIG. 3B are diagrams showing simulation curves of return loss vs. frequency, according to the dual-band patch antenna of the first and second preferred embodiments of the present invention. Such as shown in FIG. 3A, while being operated at about 2.45 GHz, the 10-dB frequency bandwidth of the dual-band patch antenna is about 138 MHz, and the maximum return loss is 13.45 dBi; while being operated at about 5.4 GHz, the 10-dB frequency bandwidth of the dual-band patch antenna is about 1010 MHz, and the maximum return loss is 13.45 dBi (at about 5.314 GHz). Such as shown in FIG. 3B, while being operated at about 2.45 GHz, the 10-dB frequency bandwidth of the dual-band patch antenna is about 135 MHz, and the maximum return loss is 13.15 dBi (at about 2.444 GHz); while being operated at about 5.4 GHz, the 10-dB frequency bandwidth of the dual-band patch antenna is about 1007 MHz, and the maximum return loss is 24 d dBi B (at about 5.314 GHz).

Figure 4A:
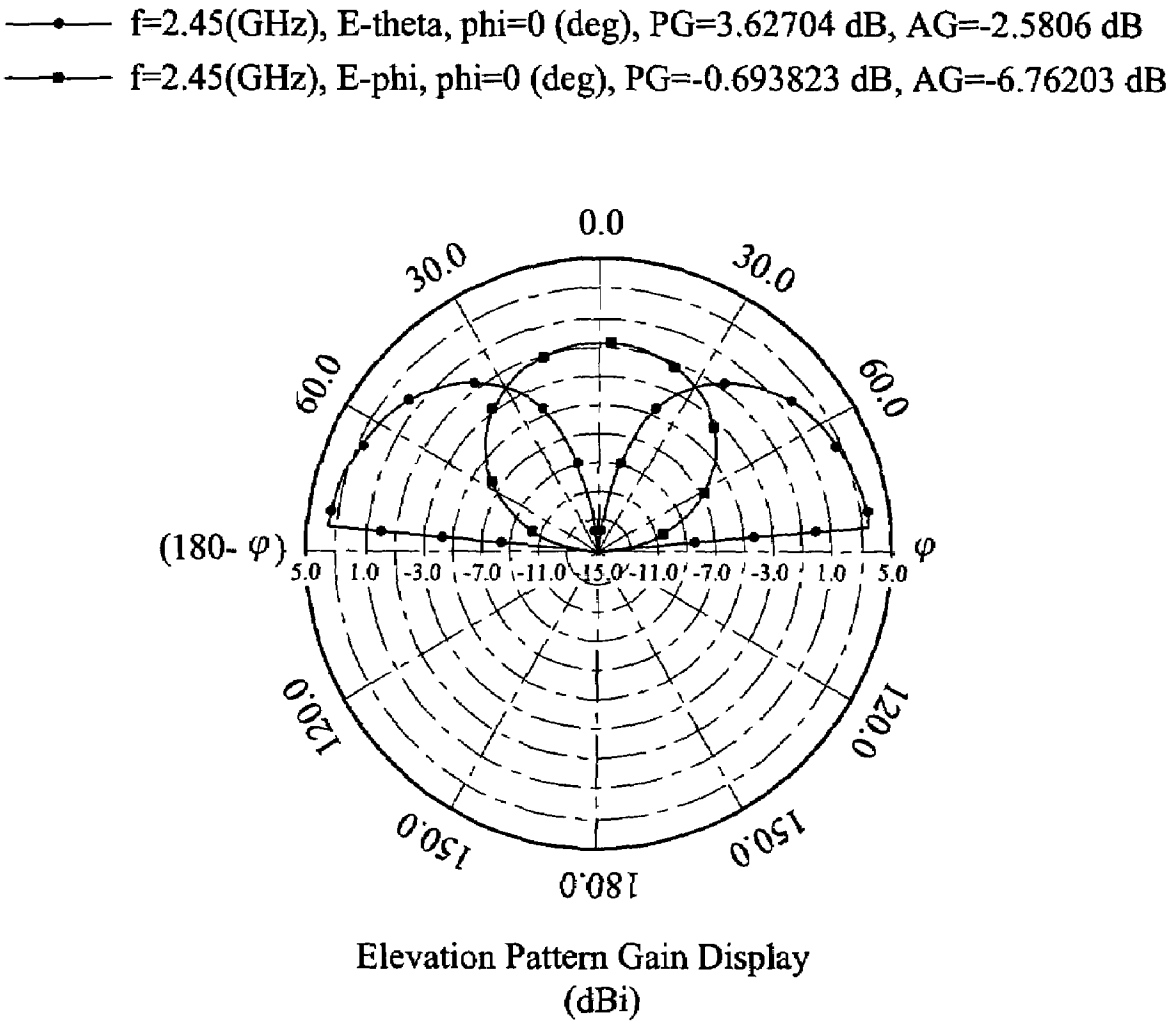
FIG. 4A is a diagram showing an elevation radiation pattern when the dual-band patch antenna of the first preferred embodiment is operated at 2.45 GHz, wherein $\Phi=0°$.
Figure 4B:
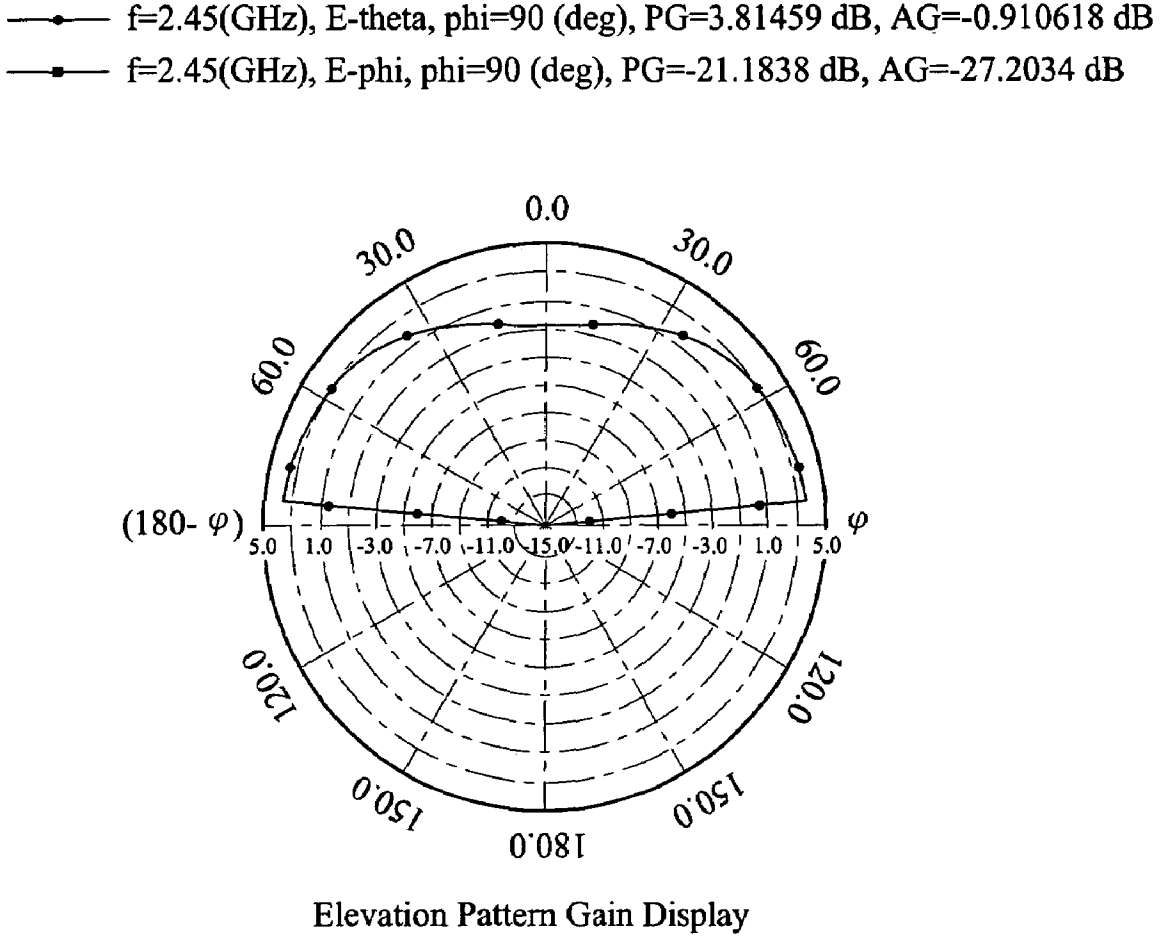
FIG. 4B is a diagram showing an elevation radiation pattern when the dual-band patch antenna of the first preferred embodiment is operated at 2.45 GHz, wherein $\Phi=90°$.
Figure 4C:
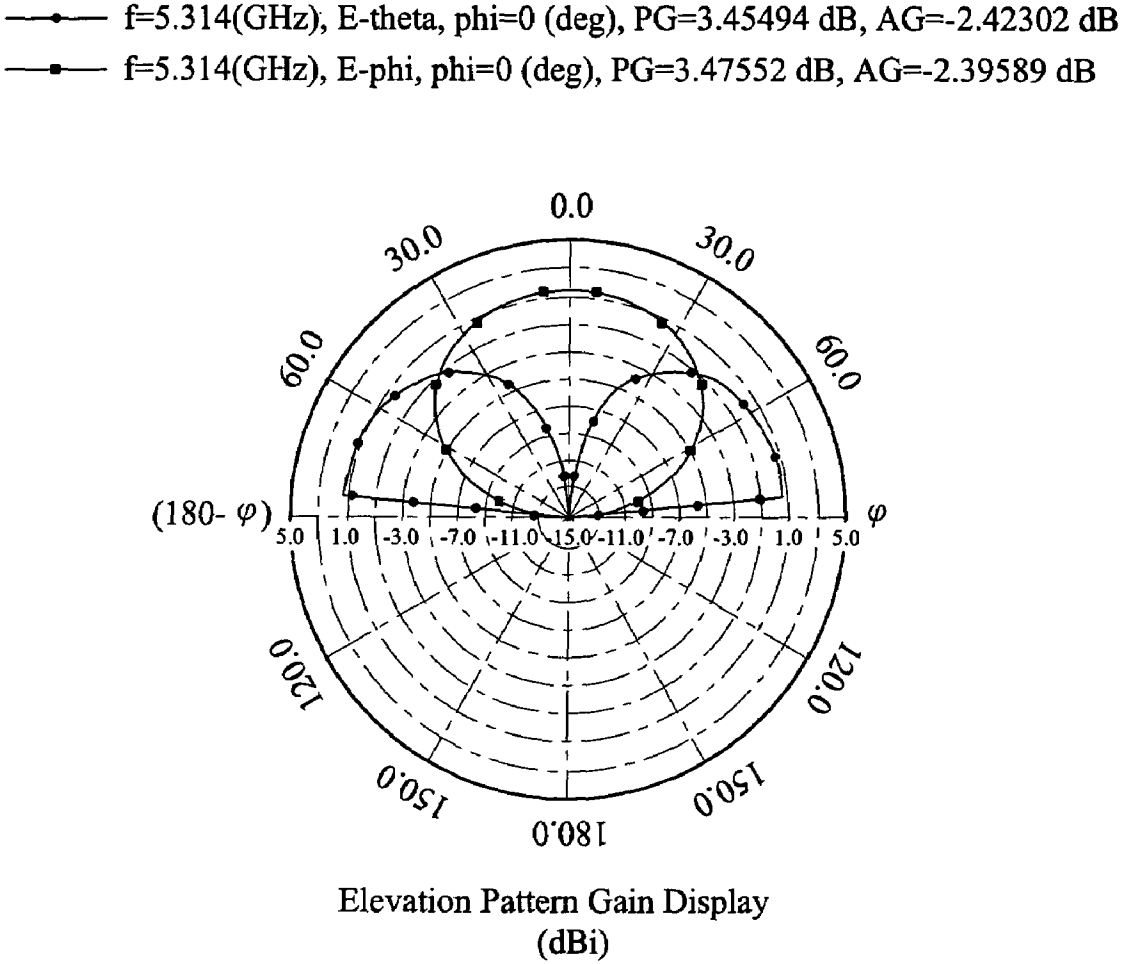
FIG. 4C is a diagram showing an elevation radiation pattern when the dual-band patch antenna of the first preferred embodiment is operated at 5.314 GHz, wherein $\Phi=0°$.
Figure 4D:
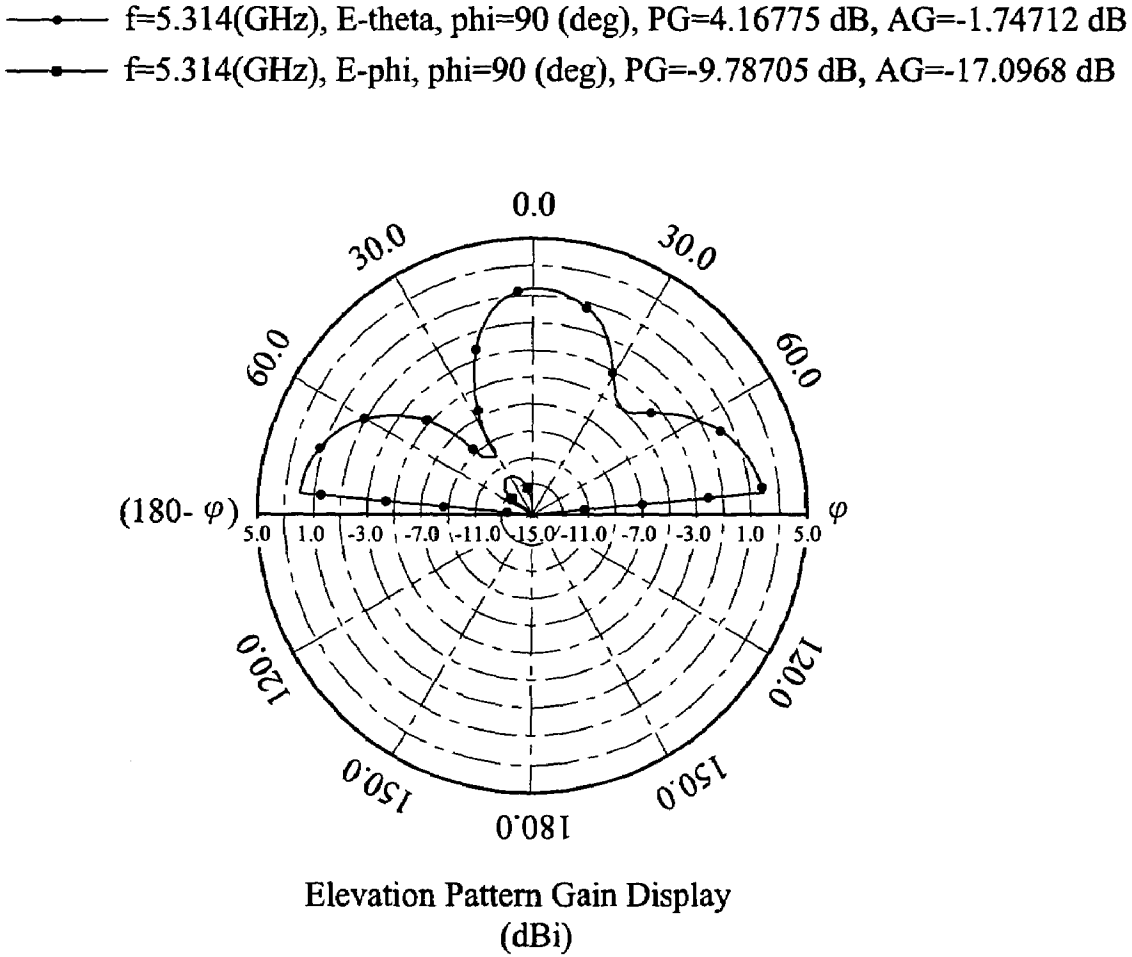
FIG. 4D is a diagram showing an elevation radiation pattern when the dual-band patch antenna of the first preferred embodiment is operated at 5.314 GHz, wherein $\Phi=90°$.

Referring FIG. 4A to FIG. 4D, FIG. 4A and FIG. 4B are diagrams showing elevation radiation patterns when the dual-band patch antenna of the first preferred embodiment is operated at 2.45 GHz, wherein $\Phi=0°$ and $\Phi=90°$ respectively; FIG. 4C and FIG. 4D are diagrams showing elevation radiation patterns when the dual-band patch antenna of the first preferred embodiment is operated at 5.314 GHz, wherein $\Phi=0°$ and $\Phi=90°$ respectively. Accordingly, it can be known from FIG. 4A to FIG. 4D that the dual-band patch antenna of the first preferred embodiment demonstrates excellent radiation patterns at two central frequencies (2.45 GHz and 5.314 GHz), thus sufficiently satisfying user requirements.

Figure 5A:
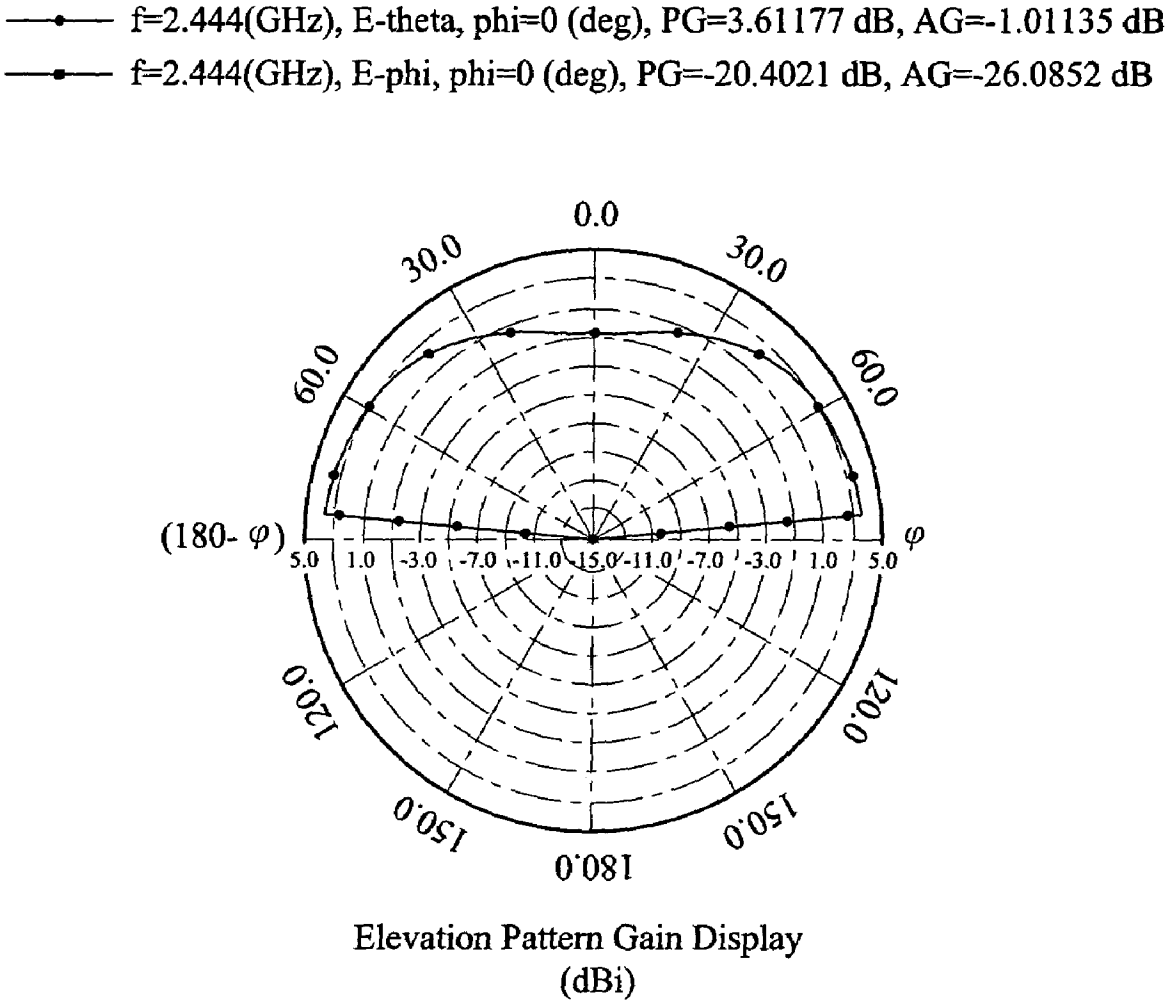
FIG. 5A is a diagram showing an elevation radiation pattern when the dual-band patch antenna of the second preferred embodiment is operated at 2.444 GHz, wherein $\Phi=0°$.
Figure 5B:
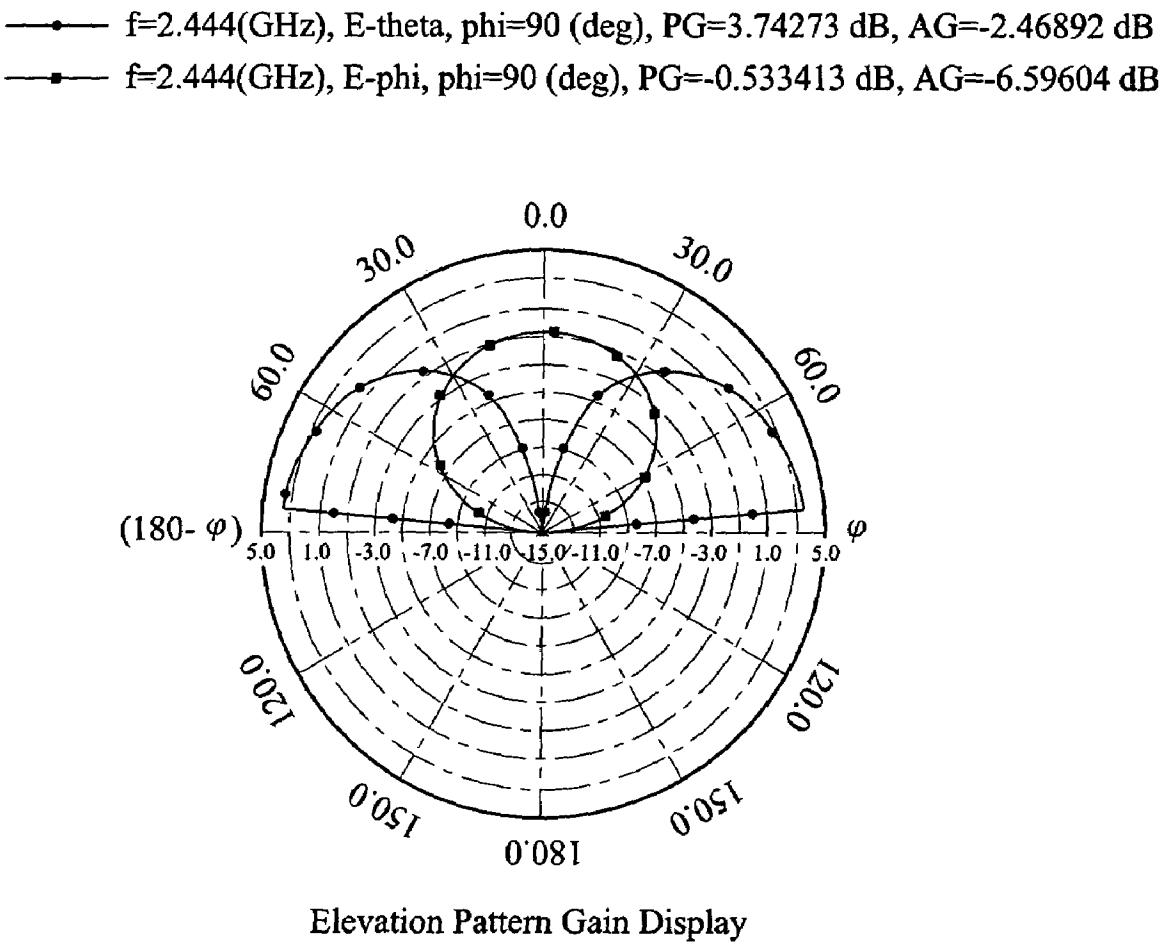
FIG. 5B is a diagram showing an elevation radiation pattern when the dual-band patch antenna of the second preferred embodiment is operated at 2.444 GHz, wherein $\Phi=90°$.
Figure 5C:
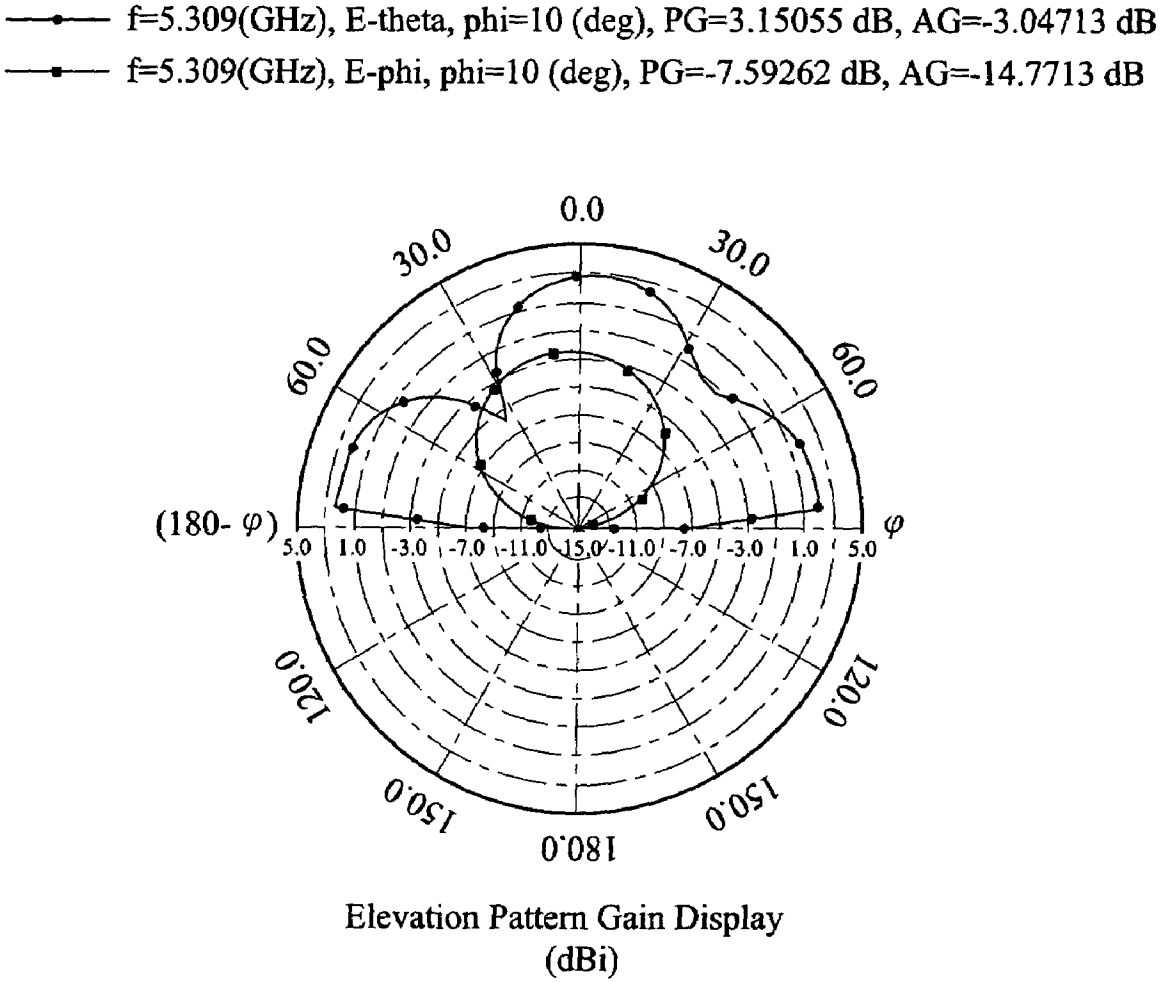
FIG. 5C is a diagram showing an elevation radiation pattern when the dual-band patch antenna of the second preferred embodiment is operated at 5.309 GHz, wherein $\Phi=10°$.
Figure 5D:
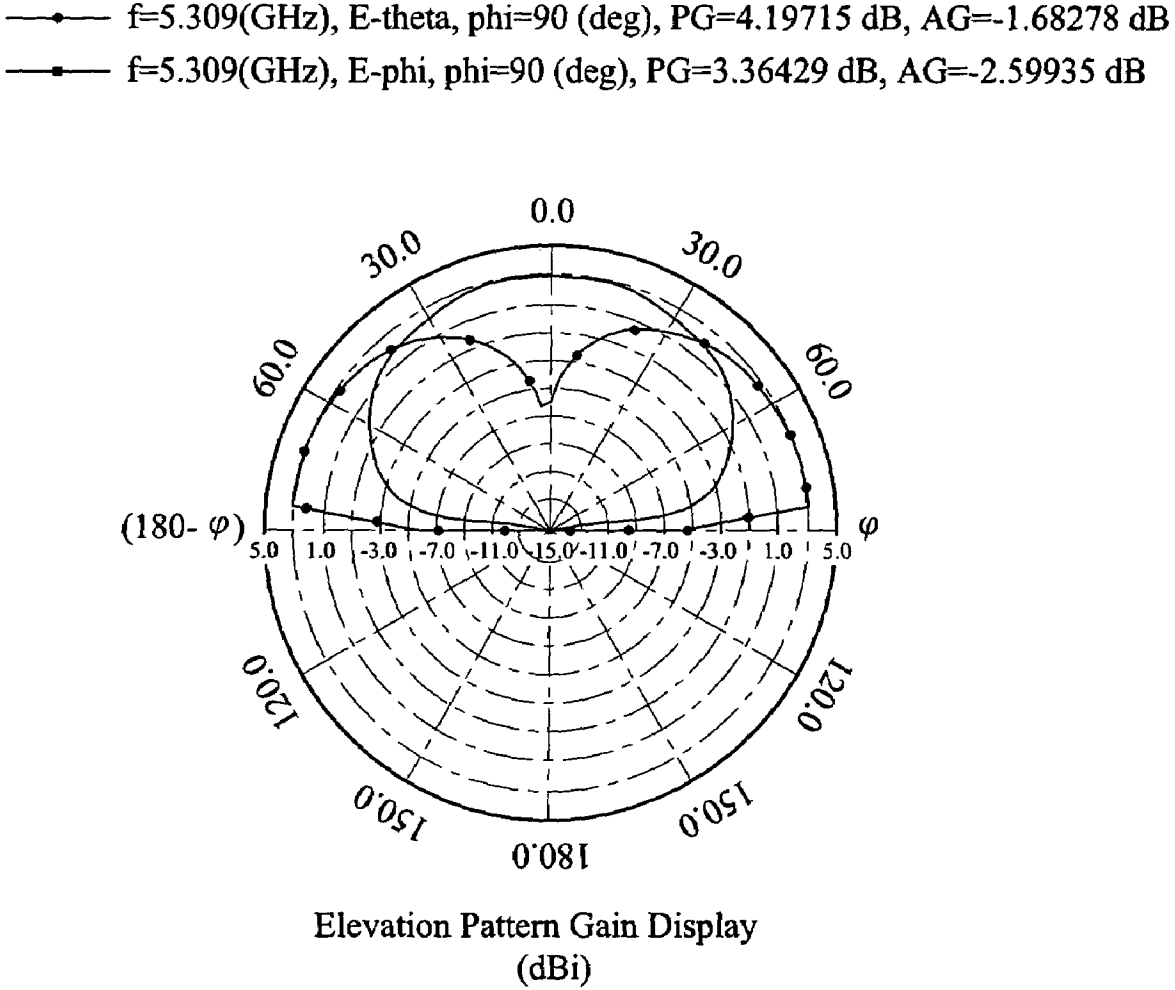
FIG. 5D is a diagram showing an elevation radiation pattern when the dual-band patch antenna of the second preferred embodiment is operated at 5.309 GHz, wherein $\Phi=90°$.

Referring FIG. 5A to FIG. 5D, FIG. 5A and FIG. 5B are diagrams showing elevation radiation patterns when the dual-band patch antenna of the second preferred embodiment is operated at 2.444 GHz, wherein Φ=0° and Φ=90° respectively; FIG. 5C and FIG. 5D are diagrams showing elevation radiation patterns when the dual-band patch antenna of the second preferred embodiment is operated at 5.309 GHz, wherein Φ=10° and Φ=90° respectively. Accordingly, it can be known from FIG. 5A to FIG. 5D that the dual-band patch antenna of the first preferred embodiment demonstrates excellent radiation patterns at two central frequencies (2.444 GHz and 5.309 GHz), thus sufficiently satisfying user requirements.

Just as described in the aforementioned preferred embodiments of the present invention, the dual-band patch antenna of the present invention has the advantages of wide frequency range, simple structure, small size, and light weight.

As is understood by a person skilled in the art, the foregoing preferred embodiments of the present invention are illustrated of the present invention rather than limiting of the present invention. It is intended to cover various modifications and similar arrangements included within the spirit and scope of the appended claims, the scope of which should be accorded the broadest interpretation so as to encompass all such modifications and similar structures.

What is claimed is:

1. A dual-band patch antenna, comprising:

a base board;

a first rectangular radiator having a first corner portion and a second corner portion, wherein said first corner portion is diagonally opposite to said second corner portion;

a second rectangular radiator having a third corner portion, wherein said second corner portion is orthogonally overlapped with said third corner portion coplanarly so as to form an overlap portion;

a feeding line connected to a feed point located on said overlap portion;

a first shorting strip connected to a first short point located on said first corner portion of said first rectangular radiator; and a second shorting strip connected to a second short point adjacent to one longer side of said second rectangular radiator with a predetermined distance spaced from the shorter side of said second rectangular radiator adjacent to said third corner portion, wherein said one longer side is located away from said overlap portion;

wherein said first short strip and said second short strip are connected to a ground plane located on said base board.

2. The dual-band patch antenna of claim 1, wherein both longer sides of said first rectangular radiator are respectively parallel to both shorter sides of said second rectangular radiator.

3. The dual-band patch antenna of claim 1, wherein both longer sides of said first rectangular radiator are respectively parallel to both longer sides of said second rectangular radiator.

4. The dual-band patch antenna of claim 1, wherein said feeding line is selected from the group consisting of a probe feed, a mircostrip transmission line and coaxial feeding line.

5. The dual-band patch antenna of claim 1, wherein the straight distance between said feed point and said first short point is substantially equal to the straight distance between said feed point and said second short point.

6. The dual-band patch antenna of claim 1, wherein low dielectric-constant foam is filled on the space between said base board and the combination of said first rectangular radiator and said second rectangular radiator.

7. The dual-band patch antenna of claim 1, wherein said first rectangular radiator is smaller than said second rectangular radiator.

8. The dual-band patch antenna of claim 1, wherein the shape of said overlap portion is a square.

9. A dual-band patch antenna, comprising:

a base board;

a first cut-cornered rectangular radiator having a first corner portion and a first connecting side, wherein said first connecting side is the slant line of the cut corner diagonally opposite to said first corner portion;

a second cut-cornered rectangular radiator having a second connecting side, wherein said second connecting side is the slant line of the cut corner of said second cut-cornered rectangular radiator, and said first connecting side is aligned and connected with said second connecting side coplanarly;

a feeding line connected to a feed point located on the joint of said first connecting side and said second connecting side;

a first shorting strip connected to a first short point located on said first corner portion of said first cut-cornered rectangular radiator; and a second shorting strip connected to a second short point located on one longer side of said second cut-cornered rectangular radiator with a predetermined distance spaced from the shorter side of said second cut-cornered rectangular radiator adjacent to said second connecting side, wherein said one longer side is located away from the joint of said first connecting side and said second connecting side;

wherein said first short strip and said second short strip are connected to a ground plane located on said base board.

10. The dual-band patch antenna of claim 9, wherein both longer sides of said first cut-cornered rectangular radiator are respectively parallel to both shorter sides of said second cut-cornered rectangular radiator.

11. The dual-band patch antenna of claim 9, wherein both longer sides of said first cut-cornered rectangular radiator are respectively parallel to both longer sides of said second cut-cornered rectangular radiator.

12. The dual-band patch antenna of claim 9, wherein said feeding line is selected from the group consisting of a probe feed, a mircostrip transmission line and coaxial feeding line.

13. The dual-band patch antenna of claim 9, wherein the straight distance between said feed point and said first short point is substantially equal to the straight distance between said feed point and said first short point.

14. The dual-band patch antenna of claim 9, wherein low dielectric-constant foam is filled on the space between said base board and the combination of said first rectangular radiator and said second rectangular radiator.

15. The dual-band patch antenna of claim 9, wherein said first rectangular radiator is smaller than said second rectangular radiator.

* * * * *